US006125495A

United States Patent [19]

Berg et al.

[11] Patent Number: 6,125,495

[45] Date of Patent: Oct. 3, 2000

[54] VARIABLE DIAMETER CLEANING BRUSH

[75] Inventors: David W. Berg, Plymouth; Bruce F. Field, Golden Valley; Earl O. F. Krueger, Jr., Eagan, all of Minn.

[73] Assignee: Tennant Company, Minneapolis, Minn.

[21] Appl. No.: 09/197,060

[22] Filed: Nov. 20, 1998

[51] Int. Cl.[7] ..... A46B 7/10; A46B 13/02

[52] U.S. Cl. ..... 15/183; 15/179

[58] Field of Search ..... 15/53.2, 53.3, 15/179, 181, 182, 183; 451/496, 502

[56] References Cited

U.S. PATENT DOCUMENTS

| | | | |
|---|---|---|---|
| 23,526 | 4/1859 | Edson . | |
| 30,644 | 11/1860 | Longley . | |
| 35,365 | 5/1862 | Daboll . | |
| 220,413 | 10/1879 | Pittman . | |
| 417,566 | 12/1889 | Knowles et al. . | |
| 436,520 | 9/1890 | Fisher . | |
| 469,030 | 2/1892 | Newlove . | |
| 503,928 | 8/1893 | Fisher . | |
| 542,571 | 7/1895 | Reynolds . | |
| 576,091 | 2/1897 | Christoph . | |
| 808,006 | 12/1905 | Butler . | |
| 857,415 | 6/1907 | Pum . | |
| 857,525 | 6/1907 | Kern, Jr. . | |
| 1,594,685 | 8/1926 | Osius . | |
| 1,803,086 | 4/1931 | Allen . | |
| 2,098,262 | 11/1937 | Temple . | |
| 2,104,062 | 1/1938 | Temple . | |
| 2,118,276 | 5/1938 | Temple . | |
| 2,254,677 | 9/1941 | Festini . | |
| 3,023,440 | 3/1962 | Peabody et al. . | |
| 3,106,733 | 10/1963 | Le Counte et al. . | |
| 3,526,012 | 9/1970 | Cirino | 15/53.2 |
| 3,545,024 | 12/1970 | Randrup | 15/53.3 |
| 3,545,026 | 12/1970 | Beer . | |
| 3,579,701 | 5/1971 | Crisp, Jr. | 15/53.2 |
| 3,643,283 | 2/1972 | Jahnert et al. . | |
| 3,731,332 | 5/1973 | Bernardi | 15/53.3 |
| 3,793,663 | 2/1974 | Lieffring | 15/53.3 |
| 4,135,270 | 1/1979 | Miner . | |
| 4,375,116 | 3/1983 | Hora | 15/181 |
| 5,121,592 | 6/1992 | Jertson . | |
| 5,218,732 | 6/1993 | Pettigrew et al. . | |
| 5,592,710 | 1/1997 | Wanner et al. . | |
| 5,606,762 | 3/1997 | Droeser et al. . | |
| 5,628,081 | 5/1997 | Wanner et al. . | |
| 5,715,558 | 2/1998 | Johnson | 15/53.2 |

*Primary Examiner*—Randall E. Chin
*Attorney, Agent, or Firm*—McEachran, Jambor, Keating, Bock & Kurtz

[57] ABSTRACT

A tubular type brush for use in a cleaning machine includes a generally cylindrical driver tube adapted to be rotated about its axis for use in cleaning an adjacent floor surface. The driver tube has an exterior surface with circumferentially and axially located bristles extending outwardly therefrom. The bristles extend, when the driver tube is in an at rest position, in a direction which is closer to parallel with the driver tube exterior surface than perpendicular to the driver tube exterior surface. The bristles have tips which move outwardly from the driver tube exterior surface as the tube rotates, with the degree of the outward movement being dependent, at least in part, upon rotary speed of the driver tube.

11 Claims, 2 Drawing Sheets

30
32
34
36
38
40
42
44
46
48
50
53
54

VARIABLE DIAMETER CLEANING BRUSH

THE FIELD OF THE INVENTION

The present invention relates to surface cleaning machines such as sweeping machines and scrubbing machines which utilize cylindrical brushes with the bristles of the brush extending generally perpendicularly from the exterior of the brush cylindrical core or driver tube. Disclosed herein is a modification of the brush in which the bristles do not extend perpendicularly, as in the prior art, but rather extend in a direction which is generally at an angle to and axially along the surface of the cylindrical driver tube. The bristles are at such an extending position when the driver tube is in an at rest position. When the brush is rotated, the tips of the bristles move outwardly from the exterior of the driver tube due to centrifugal force, with the degree of outward movement being dependent upon brush speed.

The conventional method of building brushes of this type has been to attach the bristles perpendicular to the driver tube, thus they extend radially out from it. The bristles are always radial, except at the time when they contact the surface being cleaned, when they bend somewhat because they are mechanically forced against such surface by some type of brush downward pressure device. Brush pressure is generally accomplished by forcing both ends of the driver tube downward to achieve more contact with the surface being cleaned. Various monitoring systems have been developed in the past to set the brush to a desired down pressure. The main purpose in raising and lowering the brush and in varying its down pressure is to reduce or increase the brush pattern, or contact area on the surface being cleaned, making the brush cleaning action more or less aggressive. Also, the brush must be in a raised position to clear the surface for transport The present invention eliminates the need for raising and lowering the brush for transport or for working. When the brush is non-rotating, the bristles extend generally along the exterior surface of the driver tube at an angle which is closer to parallel to the tube surface than perpendicular to it, and the height of the brush in the machine is such that the bristles do not touch the surface.

When the brush is rotated at a selected speed, centrifugal force causes the flexible bristles to move outwardly to a desired position relative to the surface being cleaned, with the degree of force applied by the bristles to such surface being determined by brush speed. The bristles used in a brush of the type disclosed herein are formed of a material which has a memory in that the bristles return to their original at rest position and thus clear the surface when the brush is stopped.

SUMMARY OF THE INVENTION

The present invention relates to brushes for use in cleaning machines such as scrubbers or sweepers and particularly to such a brush in which the bristles extending outwardly from the driver tube form an angle which is closer to parallel with the driver tube surface than perpendicular to the driver tube surface.

Another purpose of the invention is to provide a brush for the described environment in which it is not necessary to lift the brush for transport or to vary brush position relative to the surface being cleaned to vary brush cleaning aggressiveness.

Another purpose is to provide a brush for the use described which will follow the contour and undulations of a surface being cleaned, with no adjustment to down force or speed.

Another purpose is to provide a brush of the type described in which the bristles can be injection molded in various combinations of size, shape and extent.

Another purpose is to provide a brush as described in which the bristles may be formed of a plastic or elastomer having a suitable memory so that the bristles always return to their original disposition.

Another purpose of the invention is to provide a brush as described in which the bristles may be a mixture of plastic and steel.

Another purpose of the invention is to provide a brush for the described environment in which the faster the brush rotates, the larger the brush pattern.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
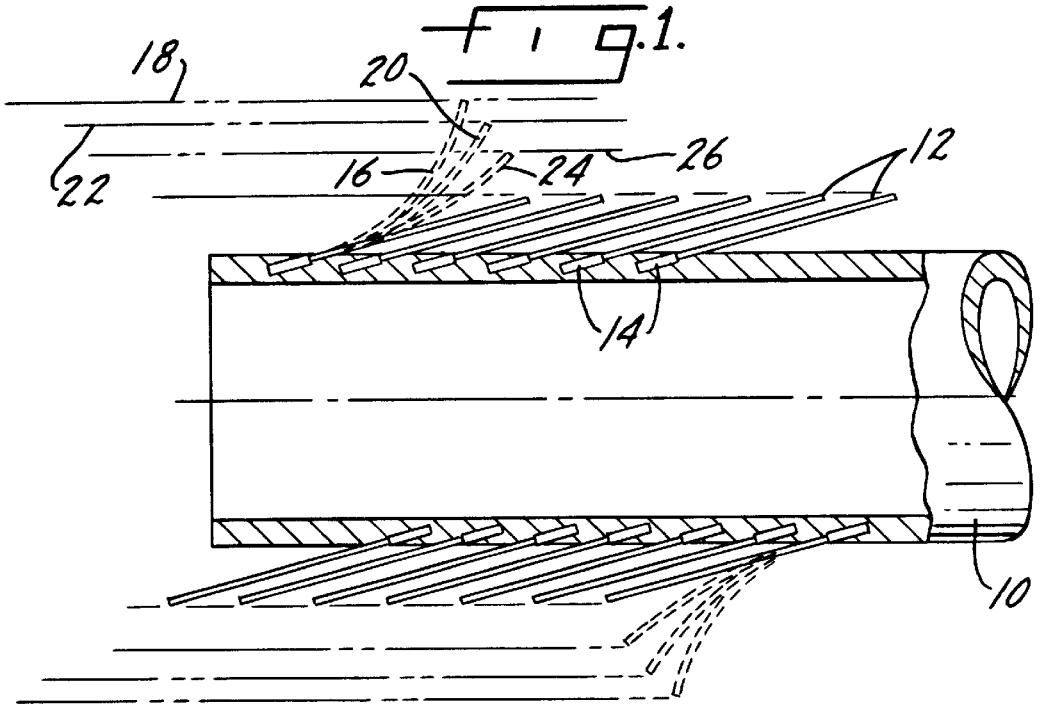
FIG. 1 is a side view, in part section, illustrating the brush of the present invention, with the bristles shown at various outward extensions from the driver tube.

The typical brush in a sweeping or scrubbing machine includes a cylinder and bristles extending generally in a perpendicular direction to the cylinder axis. The pressure applied by the brush in cleaning, which determines the aggressiveness of the cleaning operation, is controlled by a mechanism which raises and lowers the brush and thus fixes its relative position to the surface being cleaned. There are complicated mechanisms for sensing brush down pressure and making the necessary adjustments to keep such down pressure consistent.

The present invention is directed to a totally different concept in brush construction and a concept which eliminates the need to have a mechanism for raising and lowering the brush to vary the aggressiveness of the cleaning operation or brush down pressure. Instead of having bristles which extend generally perpendicularly to the surface of the cylindrical brush driver tube, the bristles are attached so that they extend along the surface of the driver tube. When the brush is at rest, the angle between the bristle and the driver tube surface is closer to parallel with that surface than it is to perpendicular. Normally, the angle will be less than 30 degrees. An angle that has been found to be satisfactory, although the invention should not be so limited, is to have each bristle make an angle of approximately 12 degrees with the cylindrical surface of the brush driver tube.

The bristles should be formed of a material, for example a suitable plastic or elastomer, which allows the bristles to flex outwardly as the brush rotates, with the degree of outward extension being determined by the rotary speed of the cylindrical driver tube. The bristle material should be such that it has a memory in that it will return to the original at rest position when brush rotation has stopped. It has been found that varying the brush speed by 150 to 200 rpm, with 500 rpm being the high end of the speed range and 300 rpm being the low end of the speed range, will provide the desired variation in brush or cleaning aggressiveness and the desired variation in bristle pressure on the surface being cleaned.

Bristle wear and ambient temperature also effect the utility of the bristles. Again, these factors may be compensated by variations in drive speed of the brush cylinder so that a desired brush pattern can be obtained without raising and lowering the brush, but by only varying the speed of the brush cylinder.

The bristles expand outwardly from the brush cylinder as it rotates, driven by centrifugal force. Such a system in which the bristles are away from the floor when the brush is at rest and when in use extend toward and in contact with the floor to varying degrees, depending upon brush speed, eliminates the need for the typical mechanisms which raise and lower the brush as cleaning requirements dictate. Although the brush shown and described herein will be described using plastic bristles, it is clearly within the scope of the invention to have some of the bristles made of a thin metal, for example steel. This could increase brush aggressiveness and since the steel bristles will be thin and flexible, they will function in the same way due to the centrifugal force created by brush rotation.

Figure 2:
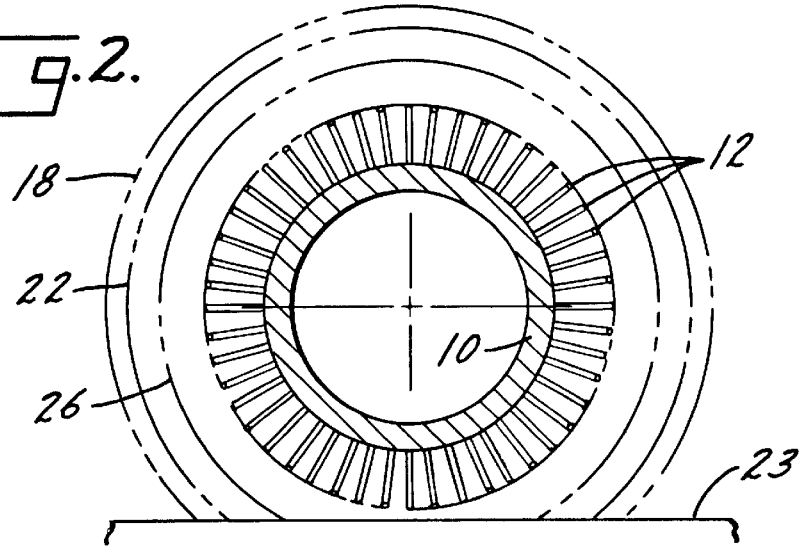
FIG. 2 is a section of the brush illustrated in FIG. 1, showing the width of the pattern, or contact area of the bristles with a surface to be cleaned, at various brush speeds, and also the non-rotating transport position of the bristles relative to the surface.

In FIG. 1, a driver tube for a typical brush for use on a cleaning machine such as a scrubber or sweeper is indicated at 10 and is in the form of a hollow cylinder. A plurality of bristles are shown at 12 and each bristle will be inserted into the exterior of the driver tube 10, being secured as at 14 by any suitable method such as, for example, by an adhesive or by heat bonding. FIGS. 1 and 2 illustrate the varying degree to which the bristles will extend, depending upon the rotary speed of the driver tube. The furthermost extension, indicated at 16, provides a brush cleaning radius represented by the broken line 18. With a lower rotary speed, as represented by the bristle 20, the effective cleaning diameter of the brush will be represented by the broken line 22. Similarly, a less aggressive cleaning force will be represented by the bristle 24, in which case the cylindrical brush will have an effective cleaning radius or diameter represented by the broken line 26. Speed of rotation and bristle flexibility and mass determine the outward extension of the bristles and thus the degree to which the brush applies cleaning force to the surface adjacent to it. The bristles, having a plastic memory, will return to the original at rest position illustrated in FIGS. 1 and 2 when the brush has ceased rotation. FIG. 2 also shows the width of the brush pattern, or contact area with the surface being cleaned, at the bristle extensions 18, 22 and 26, and the at-rest or transport position of the bristles relative to the surface 23.

Figures 3, 4, 5, 6, 7, 8:
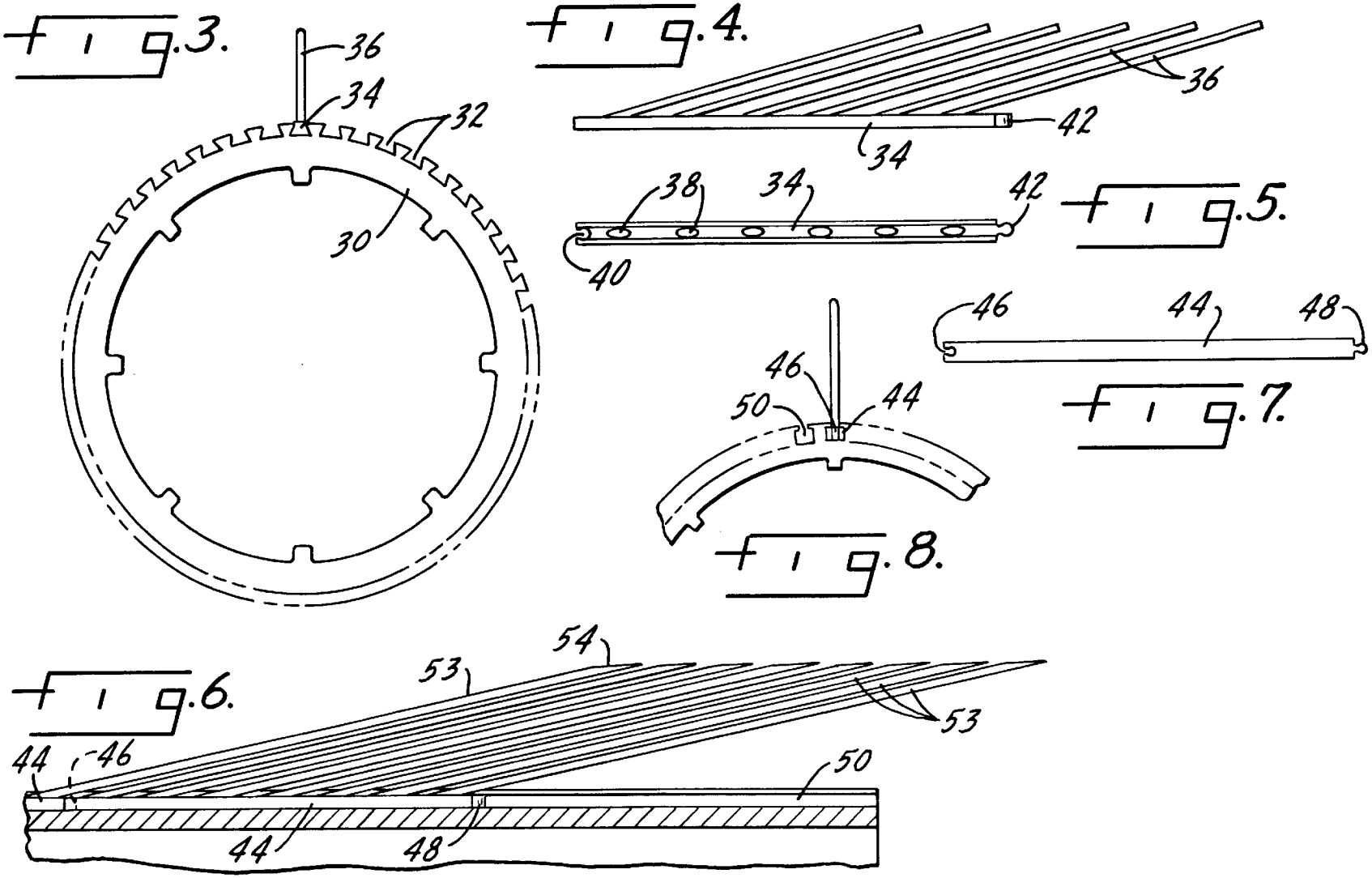
FIG. 3 is a section, similar to FIG. 2, showing a first method of mounting the bristles to the driver tube exterior surface.
FIG. 4 is a side view of a group of bristles and a bristle carrier.
FIG. 5 is a top view of the bristle carrier of FIG. 4, with the bristles shown in section.
FIG. 6 is a side view, similar to FIG. 4, illustrating a second form of bristle carrier and bristle.
FIG. 7 is a bottom view of the bristle carrier of FIG. 6.
FIG. 8 is a partial section, similar to FIG. 3, showing the bristle carrier of FIGS. 6 and 7 and a second method of mounting the bristles to the driver tube.

FIGS. 3, 4 and 5 illustrate a more detailed construction of the brush and bristles. The driver tube is indicated at 30 and has a plurality of generally uniformly spaced dovetail slots 32 which may be parallel to the axis of the driver tube or arranged in a helical manner around it. Each of these slots will hold one or more bristle carriers 34 shown in FIGS. 4 and 5. Individual bristles 36 may be molded integrally with the carrier 34, and are shown in section at 38 where they join the carrier 34. There may be a plurality of such carriers positioned in each of the dovetail slots 32. The carriers may interlock with each other, as each carrier 34 will have a circular opening 40 at one end and a circular projection 42 at the other end.

If desired, individual bristles may be inserted and suitably retained in the carrier, with the carriers being inserted in the longitudinally disposed slots on the driver tube 30. Again, the bristles may be of a suitable plastic or they may be of a thin, flexible steel.

FIGS. 6, 7 and 8 show a modified form of the invention. In this case, the carrier is indicated at 44 and again will have an opening 46 at one end and a projection 48 at the other end so that carriers positioned in the same slot in the driver tube will interlock. Note that the slots in the driver tube shown in FIG. 8, commonly referred to as T-slots, are closer to rectangular, rather than the wedge-shaped configuration of FIG. 3. The slots are indicated at 50. The bristles in each of the carriers 44, as with carrier 34, may be integrally molded with the carrier or individually inserted. There may be adhesive, not shown, used to fix the position of the carriers 34 or 44 in the slots 32 or 50.

In the FIGS. 6, 7 and 8 embodiment, the outer end of the bristles 53 is not perpendicular to bristle length, as shown for bristles 36 in FIG. 4, but rather is tapered, as indicated at 54 in FIG. 6, so that when the bristles 53 are in the at rest position, the outer surface thereof will be generally parallel to the exterior surface of the driver tube. Further, in this embodiment, when the bristles 53 extend outwardly, there will be a greater area of contact between the bristle outer surface and the floor area which is being cleaned than will occur when bristles 36 contact the surface being cleaned. Thus, the bristles 53 in the FIGS. 6, 7 and 8 embodiment can provide a greater aggressiveness in cleaning than the bristles 36 as described in the FIGS. 3, 4 and 5 embodiment.

It will be recognized by those skilled in the art that if bristles and carriers are, as stated above, made by a molding process, then the inherent capabilities of the molding process allow variations in bristle shape if desired. The bristles need not be limited to straight shapes with uniform cross sections as shown above, but may have non-uniform cross sections if so desired. Many variations are possible, and are included in the scope of this invention.

The invention has been described in connection with cleaning machines which may either sweep or scrub. The invention has wider application and is conceptually directed to a cleaning brush which rotates about an axis, provides variations in cleaning pressure in normal use by varying brush speed, and which may, when at rest, have its bristles positioned away from a surface to be cleaned.

Whereas the preferred form of the invention has been shown and described herein, it should be realized that there may be many modifications, substitutions and alterations thereto.

The embodiments of the invention in which an exclusive property or privilege is claimed are defined as follows:

1. A tubular type brush for use in a cleaning machine including a generally cylindrical driver tube adapted to be rotated about its axis for use in cleaning an adjacent surface, said driver tube having an exterior surface with circumferentially and axially located bristles extending outwardly therefrom, said bristles extending, when the driver tube is in an at rest position, in a direction which is closer to parallel with the driver tube exterior surface than perpendicular to the driver tube exterior surface, said bristles having tips which move outwardly from the driver tube exterior surface as said driver tube rotates, with the degree of said outward movement being dependent, at least in part, upon rotary speed of the driver tube, the exterior surface of said driver tube including a plurality of generally parallel closely spaced adjacent grooves, each of said grooves being parallel with the axis of said driver tube, a plurality of generally parallel bristle carriers, with each carrier being mounted in one of said adjacent grooves, the bristles on the exterior of said brush being arranged in groups, with each group being mounted in a respective one of said bristle carriers.

2. The brush of claim 1 wherein said bristles, in the rest position of the driver tube, form an angle with the tube exterior surface of less than about 30 degrees.

3. The brush of claim 1 wherein said bristles, in the at rest position of the driver tube, form an angle with the tube exterior surface of on the order of about 12 degrees.

4. The brush of claim 1 wherein said bristles, at least in part, are formed of plastic.

5. The brush of claim 4 wherein at least some of said bristles are formed of metal.

6. The brush of claim 1 wherein at least some of said bristles are formed of an elastomeric material.

7. The brush of claim 1 wherein each bristle carrier includes a plurality of openings, there being a bristle extending outwardly from each bristle carrier opening.

8. The brush of claim 1 wherein the bristles in a bristle carrier are integral therewith.

9. The brush of claim 1 wherein each of said grooves is generally wedge-shaped in cross section.

10. The brush of claim 1 wherein each of said grooves is generally rectangular in cross section.

11. The brush of claim 1 wherein each of said bristles has a tip, with the tip being tapered relative to the longitudinal extent of the bristle.

* * * * *